United States Patent [19]

Folk et al.

[11] 4,030,280

[45] June 21, 1977

[54] FIBER BLENDING, SUBDIVIDING, AND DISTRIBUTING SYSTEM

[75] Inventors: Craig L. Folk, New Orleans; James I. Kotter, Mandeville, both of La.

[73] Assignee: The United States of America as represented by the Secretary of Agriculture, Washington, D.C.

[22] Filed: Jan. 7, 1976

[21] Appl. No.: 647,244

[52] U.S. Cl. ..... 57/58.95; 19/106 R; 19/145.5; 19/155; 57/156; 209/135

[51] Int. Cl.[2] ..... D01H 1/12; D01G 23/08

[58] Field of Search ..... 57/50, 58.89–58.95, 57/156; 19/90, 93, 98, 99, 105, 106 R, 150, 155, 145, 145.5, 145.7; 209/135, 138, 139 R, 139 A, 146, 150

[56] References Cited

UNITED STATES PATENTS

| | | | |
|---|---|---|---|
| 3,295,307 | 1/1967 | Kyame et al. | 57/58.89 |
| 3,434,184 | 3/1969 | Doudlebsky et al. | 57/50 X |
| 3,635,006 | 1/1972 | Fehrer | 57/50 |
| 3,685,100 | 8/1972 | Brown et al. | 19/98 |
| 3,902,224 | 9/1975 | Brown et al. | 19/155 |
| 3,996,731 | 12/1976 | Koella | 57/58.95 |

*Primary Examiner*—John Petrakes
*Attorney, Agent, or Firm*—M. Howard Silverstein; Salvador J. Cangemi; David G. McConnell

[57] ABSTRACT

By combination and interaction of aerodynamic and mechanical forces, textile fibers are removed from a single source, transported, collected, blended, subdivided, and distributed in equal amounts to multiple remote locations, whereby the fibers are continuously assembled into uniform ribbons for subsequent textile processing or supplied directly to open-end spinning units.

37 Claims, 7 Drawing Figures

FIBER BLENDING, SUBDIVIDING, AND DISTRIBUTING SYSTEM

This invention relates to a method and apparatus for pneumatically collecting textile fibers from a single source, blending, subdividing, and equally distributing said fibers to remote locations for subsequent textile processing.

More specifically, the invention relates to a method and apparatus for pneumatically removing fibers from the surface of a textile processing cylinder, for example, from the doffer cylinder of a carding machine, conveying the fibers through a transitional duct into a blending, subdividing, and fiber distributing apparatus and transporting said fibers through a network of tubes to a multiplicity or plurality of condensers wherein the fibers are assembled into indentical ribbons for subsequent textile processing.

Still more specifically, the invention discloses a method and apparatus for pneumatically "cascading" fiber distribution, whereby a considerably higher number of locations can be continuously supplied equal amounts of textile fibers emanating from a single source.

To those experienced in the art of textile processing, it is known that conventional methods of yarn production consist of numerous preparatory processing steps resulting in a non-continuous flow of fibers from initial fiber opening to the spinning process. In the majority of installations fibers are manually transported to and from each process in distinctive fibrous formations, for example, picker and silver lap, card, first drawn, second drawn, and combed silver, roving, et cetera. Suffice it to say, conventional textile processing reguires numerous intricately designed machines, considerable labor, and a great expanse of textile mill floor area.

Presently, there is no existing commercial method for pneumatically removing fibers from a remotely located single source, for example, for the doffer cylinder of a carding machine, continuously forming a multiplicity of uniform fiber assemblages, each suitable as a supply source for subsequent textile processing.

Furthermore, there is no existing commercial method for pneumatically blending, subdividing and "cascading" the distribution of fibers into multitudinous condensing locations, whereby fibers are assembled into uniform ribbons each suitable for subsequent processing, or for example, supplying a multiplicity of open-end spinning units directly from the distributor.

The principal object of this invention is to simplify textile processing by elimination of many of the conventional steps in processing without sacrificing yarn and fabric quality.

Another object of this invention is to eliminate manual handling and manual distribution of textile stock prior to spinning.

Another object of this invention is to provide an automatic means of distributing equal amounts of fibers from a single source, for example, from a carding machine to multiple locations for assembly into identical ribbons for subsequent processing.

Another object of this invention is to provide aerodynamic and mechanical means for intimately blending fibers.

Another object of this invention is to provide an automatic means for distributing equal amounts of fibers from a single source, for example, from a carding machine to a multiplicity of open-end spinning units.

This invention is a unique method of automatically doffing, blending, subdividing, and distributing opened fibers from a fibrous lap or web to a multiplicity of OE spinning units or fiber individualizing devices, for example, as described in U.S. Pat. No. 3,685,100.

A transitional duct encompassing a rectangular to round cross section with multiple adjustable internal baffles is the means whereby opened fibers are pneumatically removed from a lickerin-type opening cylinder or a doffer cylinder of a carding machine. The baffles serve as the means for maintaining an equal air velocity gradient across the duct to equally disburse the fibers through its round fiber outlet into a fiber distributor. The duct's round outlet serves as a journal and a pneumatic seal for a rotating fiber entrance tube of the distributor. The rotatably driven, longitudinally slotted fiber entrance tube disburses fibers into a cylindrical chamber wherein the fibers are intimately blended and subdivided into multiple outlets. Under negative air pressure throughout the entire system, the fibers are transported into the distributor and from its outlets through tubes to a multiplicity of fiber condensing units as described in U.S. Pat. No. 3,902,224, or directly to open-end spinning units.

Within a condensing unit as described in U.S. Pat. No. 3,902,224, fibers are separated from the airstream by means of grid surface. Adjacent to and in contact with each fiber condenser forming a pneumatic seal, is a rotatable take-out cylinder, in close proximity to the grid surface within the condenser, rotating at a constant speed, which withdraws said fibers from the confines of said condenser, thus continuously forming a fibrous ribbon. A curved deflection plate in close proximity to said rotating take-out cylinder, serves as a guide for feeding the newly formed fibrous ribbon to a subsequent process.

Said fibrous ribbon production rate is governed by the rotational speeds of the take-out and feed supply cylinders.

Negative air pressure generated by a blower connected to a manifold (patent application Ser. No 404,976, filed Oct. 10, 1973, now U.S. Pat. No. 3,902,224 or to open-end spinning units, provides the means for manipulating fibers within this disclosure.

Another embodiment of the invention is a fiber distributor utilizing an air flotation, elastic ball housed within a spirally vaned conical chamber adjoining a cylindrical fiber mixing chamber having a conical deflector centrally attached to its fiber exit wall. A high velocity air stream under negative pressure laden with fiber entering the conically shaped chamber creates a low pressure area (venturi) between the ball and the conic wall surface, thus forming a circumferential orifice through which airborne fibers enter the conic chamber, a swirling action takes place by virture of multiple spiral vanes attached to and protruding from the inner surface of the conical chamber. Intimate fiber blending is therefore attained aerodynamically within the chambers without the use of a rotating inner entrance tube and an additional driving means (as described in original embodiment).

Further objects and advantages of the invention will be apparent from the following specifications, drawings, and claims set forth herein.

Figure 1:
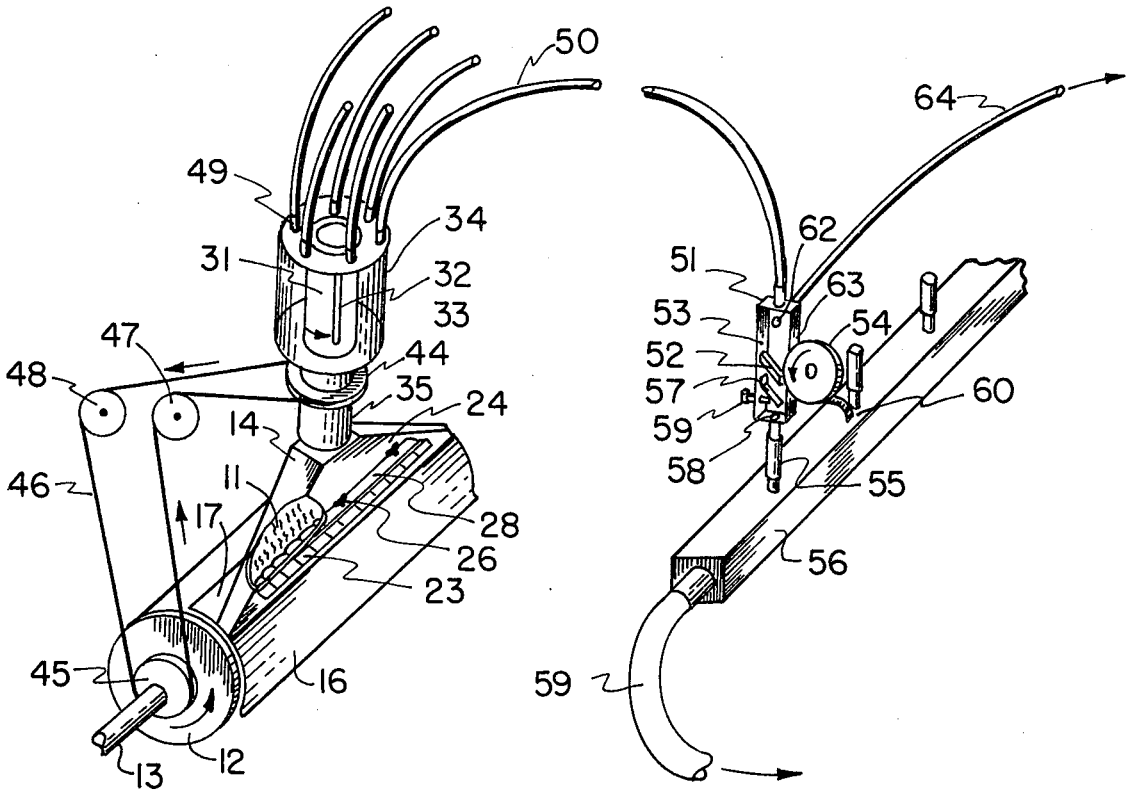
FIG. 1 is a three dimensional view of an embodiment of the invention with a portion of the transitional duct broken away to show internal baffling.

In describing the preferred embodiment of the invention illustrated in the drawings, specific terminology will be resorted to for the sake of clarity. However, it is not intended to be limited to the specific terms so selected, and it is to be understood that each specific term includes all technical equivalents which operate in a similar manner to accomplish a similar purpose.

Figure 2:
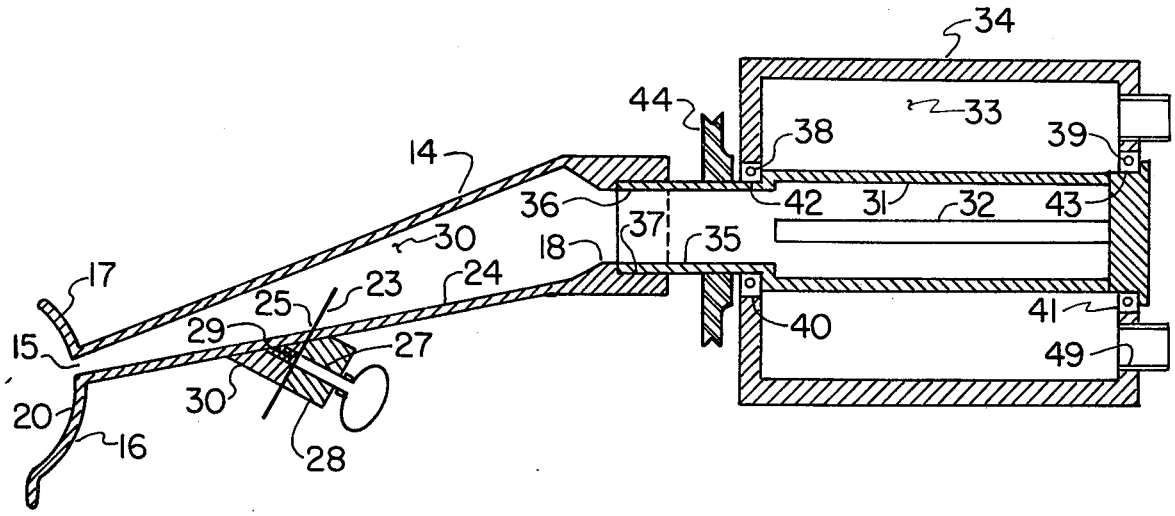
FIG. 2 is a cross-sectional view of the transitional duct of the fiber distributor showing details of baffling and of the rotary fiber distribution tube.
Figure 3:
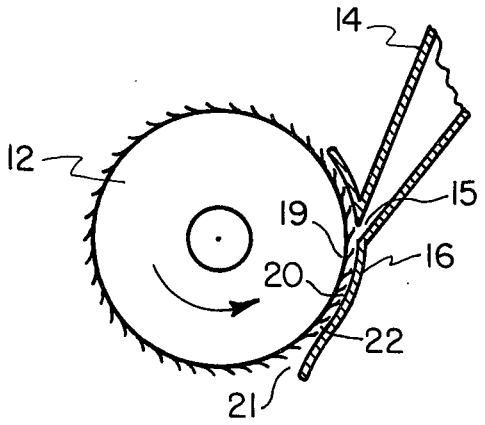
FIG. 3 is a cross-sectional partial view of the transitional duct and shrouds arrangement for pneumatically doffing a fiber processing cylinder.

Referring now to our drawings, FIGS. 1, 2, and 3, depict an embodiment of the invention wherein fibers 11 are pneumatically removed from a conventional textile processing cylinder 12 supported by and driven through shaft 13 (bearings and drive means not shown). Negative air is generated by a vacuum pump (not shown). Air is drawn from the atmosphere into the system at cylinder 12.

Fibers 11 are drawn into transitional duct 14 by a high velocity negative air stream through nozzle 15 extending to the width extremity of cylinder 12. Duct 14 equipped with cylinder shrouds 16 and 17 respectively, transitions from nozzle 15 to round outlet 18.

Referring to FIG. 3, cylinder shroud 16 is located a slight distance from processing cylinder 12. Peripheral surface 19 of cylinder 12 and inner surface 20 of shroud 16, establish air intake opening 21 and air passage 22. Air passage 22 serves as a means for providing a high velocity air stream to efficiently remove all fibers 11 from processing cylinder 12 into nozzle 15 of transitional duct 14.

Referring again to FIGS. 1 and 2, transitional duct 14 is equipped with multiple adjustable baffles 23 extending through duct wall 24 at slotted opening 25. Said baffles 23 are held in position by thumb screws 26 inserted through clearance holes 27 of removable bar 28 and into tapped holes 29 of wall protubrance 30.

Baffles 23 are slotted (not shown) to allow passage of thumb screws 26. Baffles 23 are a means for establishing an optimum air velocity gradient across passage 30 and through transitional duct 14 to equally disburse fibers 11 into rotary tube 31, through its slotted wall 32 and subsequently into cylindrical mixing chamber 33 of distributor 34.

Rotary tube 31 integrally consists of a smaller diameter fiber entrance tube 35 which forms a rotary connection with transitional duct 14. The round outlet 18 of duct 14 is recessed, establishing inner end surface 36 and circular wall 37 which serve as a journal and a pneumatic seal for fiber entrance tube 35.

Sealed ball bearings 38 and 39 are press fitted into circular openings 40 and 41 respectively, of fiber distributor 34. Rotary tube 31 is circumferentially supported at peripheral surfaces 42 and 43.

Pulley 44 is secured to fiber entrance tube 35. Pulley 45 is secured to shaft 13.

Rotary tube 31 is driven by rotation of pulley 45 which is interconnected with pulley 44 by means of belt 46 traveling in guide pulleys 47 and 48.

Longitudinal slotted wall 32 of rotary tube 31 provides equal disbursion of fibers 11 into cylindrical chamber 33 of distributor 34, wherein airborne fibers 11 are intimately blended and subdivided into multiple outlets 49.

Figure 4:
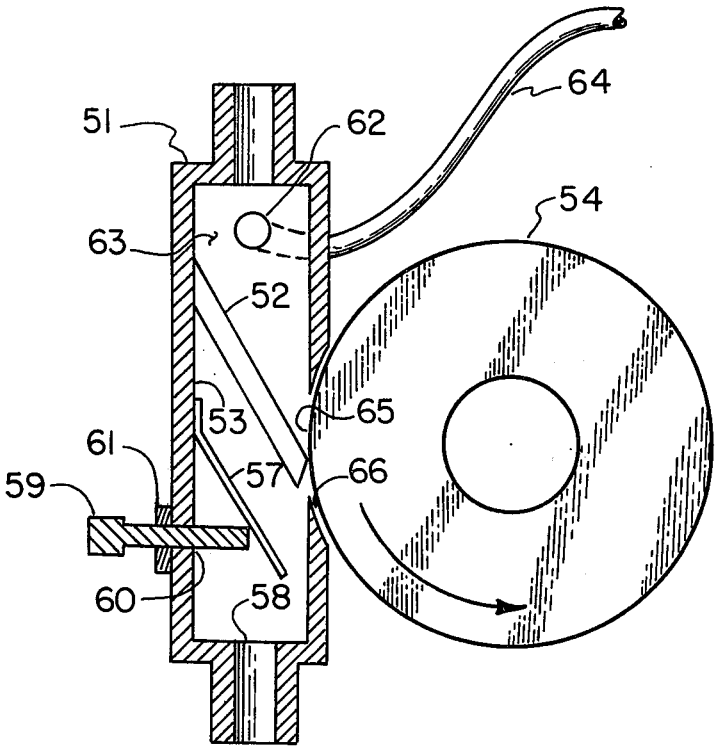
FIG. 4 is a cross-sectional view of a mini-fiber condenser with reed regulator valve and resilient take-out cylinder.

Referring to FIGS. 1, 2, and 4, under negative air pressure, fibers 11 are transported from distributor outlets 49 through tubes 50 to a multiplicity of mini-condensers 51. Within each condenser 51, fibers 11 are separated from the airstream by means of an inclined grid 52, which extends from condenser wall 53 to close proximity of resilient take-out roller 54.

The air flows through grid 52 out of condenser 51 through connecting tube 55 into a common manifold 56. Manifold 56 is connected to a suction source (not shown), by flexible hose 59.

Equalization of air pressure above grid 52 of each condenser 51 prior to distribution of fiber 11 among a multiplicity of condensers 51 is accomplished by manual adjustment of reed regulator valve 57 attached to each condenser wall 53 adjacent exit opening 58. Static balancing of condensers 51 compensates for inherent fabrication differences. Valve 57 is moved by regulator screw 59 traversing through corresponding tapped hole 60 in condenser wall 53. Regulator screw 59 is held in desired position by lockout 61.

Pressure within condenser 51 is gauged and monitored by means of a manometer or a pressure gauge (not shown) connected to opening 62 in side wall 63 of condenser 51 by tube 64.

Experimentation utilizing six mini-condensers has shown that fiber delivery variation among condensers can be controlled at less than 5%.

Referring to FIGS. 1 and 4, inclination of grid 52 and location of valve 57 are responsible for assembly of fibers at nip 65 formed by valve 57 and take-out roller 54.

The rotating resilient take-out cylinder 54 forming a pneumatic seal with condenser 51 and in close proximity to the terminal end of grid 52 withdraws the fibers 11 from the confines of condenser 51 through passage 66, forming a continuous fibrous ribbon 60 for subsequent textile processing.

Figure 5:
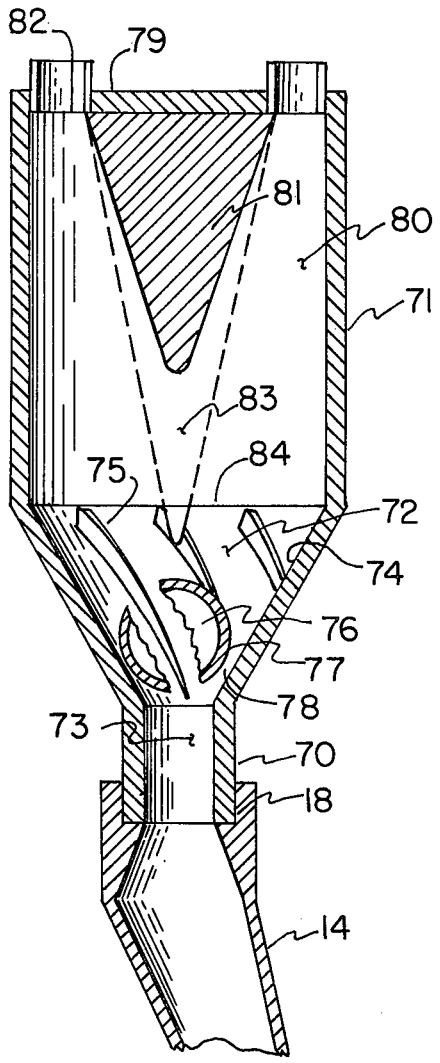
FIG. 5 is a cross-sectional view of another embodiment of the invention showing a fiber distributing utilizing a light elastic ball, a spirally vaned one, and a conic diffuser for fiber blending, subdividing, and distributing.
Figure 6:
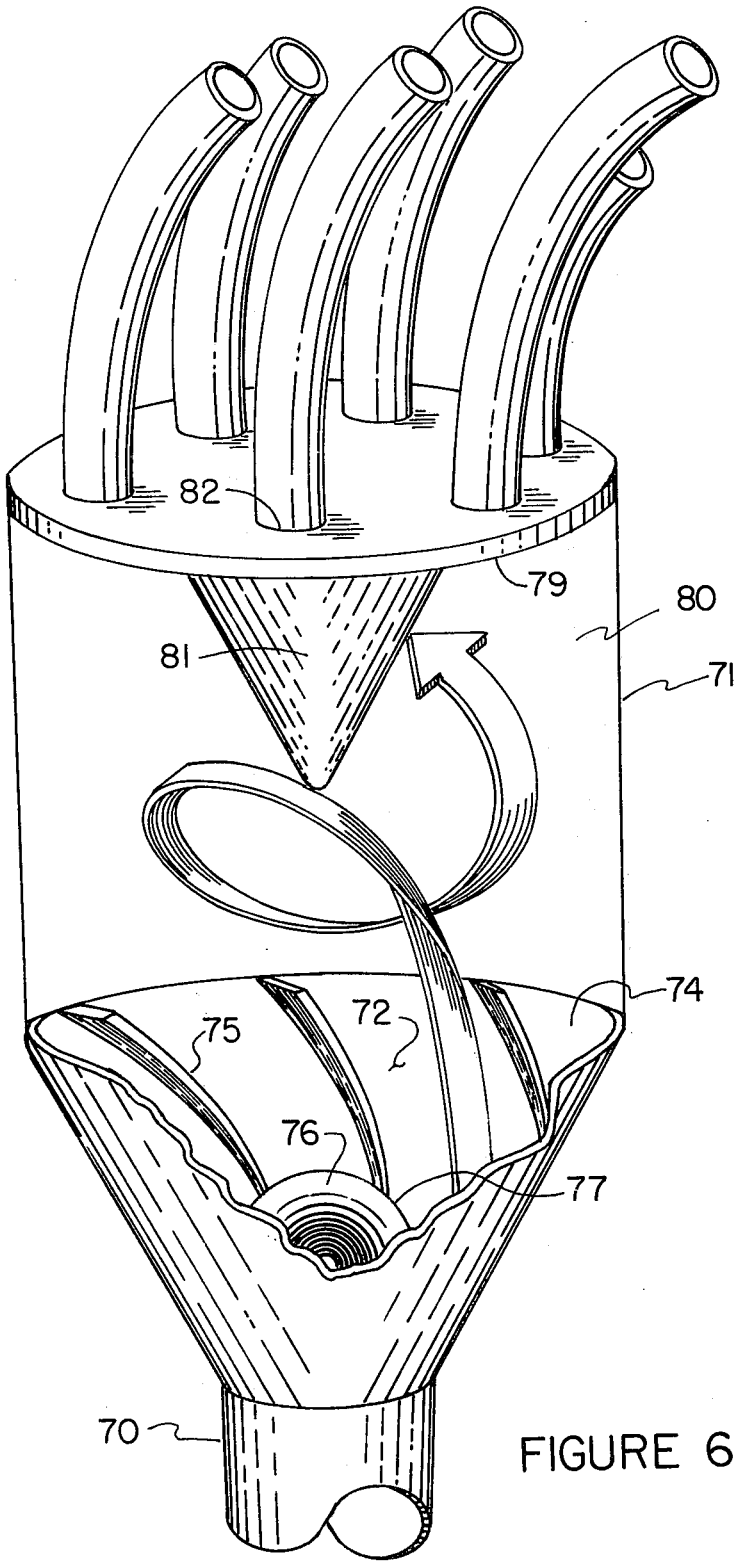
FIG. 6 is a three dimensional view of the embodiment of the invention depicting an alternate means for blending, subdividing, and distributing fibers.

FIGS. 5 and 6 illustrates another embodiment of the invention wherein tubular projection 70 of fiber distributor 71 is press fitted into recessed round outlet 18 of duct 14 forming a pneumatic seal. Airborne fibers 11 enter conical chamber 72 through tubular passage 73.

Radially encircling the inner wall surface 74 of conical chamber 72 are attached multiple, equally spaced, spirally shaped, tapered vanes 75. Vanes 75 taper from apex of conical chamber 72 to intersection 84 of conical chamber 72 and cylindrical chamber 80.

Into the apex of conically shaped chamber 72 is an unattached hollow elastic ball 76 whose outside diameter is greater than the inside diameter of tubular passage 73 and less than half the mean inside diameter of conical chamber 72.

During operation, high velocity air under negative pressure laden with fibers 11 entering chamber 72, creates a low pressure area between outside surface 77 of ball 76 and inside wall surface 74 of conical chamber 72. By virtue of the low pressure created by the air movement, ball 76 is aerodynamically positioned and held symmetrically within the confines of chamber 72, establishing circumferential channel 78 during operation, thus providing a means for equal distribution of air, laden with fiber 11 (through circumferential channel 78) into conical chamber 72.

As the air laden with fibers 11 enters chamber 72, it is caused to divide by virtue of the "Conanda Effect," a portion clinging to the outside surface 77 of ball 76 and a portion clinging to the inside wall surface 74 of conic chamber 72. The portion of air clinging to surface 77 is forced to swirl by virtue of vanes 75 and the portion of air clinging to surface 77 of ball 76 is compelled to converge centrally as it leaves surface 76 of ball 75.

Affixed to fiber exit wall 79 of cylindrical chamber 80 is conic deflector 81. Fiber exit openings 82 are equally spaced apart and surround conic deflector 81.

Efficient pneumatic blending is obtained as the converging fibers 11 are deflected by conic deflector 81 into the swirling stream of fibers 11.

Referring specifically to FIG. 6, for operation of fiber distributor 71 in positions other than vertical, extended conical deflector 83 is employed (indicated by broken line) to confine ball 76 to vicinity of the apex of conical chamber 72.

Although six fiber exit openings are shown in the drawings, the invention is not so limited by this number.

Figure 7:
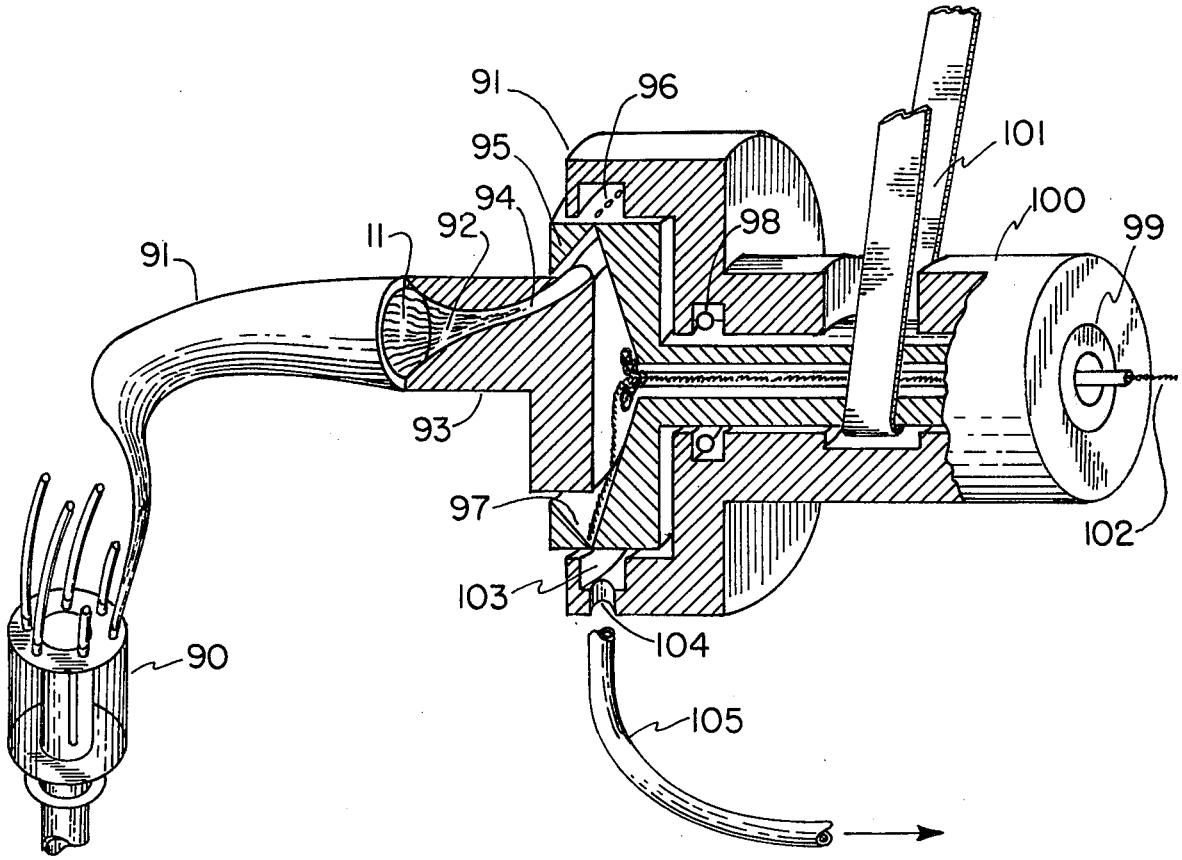
FIG. 7 is a three dimensional view of another embodiment of the invention showing a method of distributing fibers directly to open-end yarn spinners.

In another embodiment of our invention, FIG. 7, fibers 11 are distributed directly form distributor 90 to a multiplicity of open-end yarn spinners 91. OE spinners can be of conventional design adapted for utilization with the embodiment or for example, an OE spinner as described in U.S. patent application Ser. No. 633,066 filed Nov. 18, 1975, now U.S. Pat. No. 4,005,568, can be empolyed.

Fibers 11 are drawn from distributor 90 through tube 91 into entrance passage 92 of stationary member 93 by negative air pressure. Fiber passage 92 converges into venturi 94. As each fiber's 11 velocity increases through venturi 94, its configuration is changed. The fibers 11 are straightened and aligned prior to entry into spinner rotor 95.

Fibers 11 are drawn into rotor 95 either by means of a suction source (not shown) or by the pumping action of rotor 95, through its peripheral holes 96.

By the resulting action of suction and centrifugal force, fibers 11 are deposited into circular apex 97 of rotor 95. Rotor 95 is rotatably supported by ball bearings 98 and (99 not shown) in spinner housing 100. Rotor 95 is driven by belt 101. Rotation of rotor 95 in combination with yarn take out means (not shown) results in formation of yarn 102 within rotor 95.

Spinner housing 100 is circularly recessed, forming air passage 103. Into air passage 103 is circular hole 104 for continuity of air flow to suction source (not shown) through connecting tube 105.

We claim:

1. An apparatus for removing textile fibers from a single source, transporting, collecting, blending, subdividing, and distributing said fibers in equal amounts to multiple remote locations, whereby said fibers are continuously assembled into uniform ribbons for subsequent textile processing or supplied directly to open-end spinning units comprising in combination:

a. a fiber feeding means comprising:
   1. a cylinder supported and driven by a shaft,
   2. a pneumatic system drawing air from the atmosphere across the circumference or pheriphery of said cylinder by means of
      A. a vacuum suction, said fiber feeding means discharging into b. a collecting means comprising a transitional duct encompassing a rectangular to round cross-section with multiple internal baffles, said baffles serving as a means of maintaining equal air velocity gradient across the transitional duct to equally disperse fibers through a round fiber outlet, said round outlet also serving as a journal and pneumatic seal for c. a fiber distribution means comprising:
   1. a rotating fiber entrance tube, longitudinally slotted and disbursing fibers into
   2. a cylindrical chamber wherein the fibers are intimately blended and sub-divided into multiple outlets
   3. a negative air pressure means for transporting said fibers into said cylindrical chamber, d. a means of transporting the fibers from the multiple outlets to a multiplicity/plurality of condensing units or open-end spinners comprising a plurality of tubes, e. a condensing unit comprising a grid surface to separate fibers from the airstream and f. a rotatable take-out cylinder adjacent to and in contact with each fiber condenser forming a pneumatic seal, and in close proximity to the grid surface within the condenser, rotating at a low speed, thereby withdrawing fibers from the confines of said condenser resulting in a continuous forming of a fiber ribbon, at a determined production rate, g. a curved deflection plate in close proximity to the rotating take-out cylinder serving as a guide for feeding the newly formed fibrous ribbon to a subsequent process.

2. The apparatus as defined in claim 1 wherein the determined production rate is governed by synchronous rotational speeds of the take-out and feed supply cylinders.

3. The apparatus of claim 1 wherein negative air pressure is generated by a blower connected to a manifold or to an open-end spinning unit, provides the means of manipulating fibers.

4. The apparatus of claim 1 wherein fibers are drawn into the transitional duct by a high velocity negative air stream through a nozzle which extends the width extremity of the cylinder and said transitional duct which transitions from the nozzle to the round outlet is equipped with cylindrical shrouds.

5. The apparatus of claim 4 wherein the cylinder shrouds are located a slight distance from the processing cylinder and the peripheral surfaces of the cylinder and inner surface of the shrouds establish an air intake opening and passage, said air passage serving as a means for providing a high velocity air stream to efficiently remove all fibers from the processing cylinder into the nozzle of the transitional duct.

6. The apparatus of claim 1 wherein the transitional duct is equipped with multiple adjustable baffles extending through the duct wall at slotted openings.

7. The apparatus of claim 6 wherein the baffles are held in position by thumb screws inserted through clearance holes of a removable bar and into tapped holes of a wall proturbance, said baffles slotted to allow passage of said thumb screws, said baffles thereby being a means of establishing an optimum air velocity gradient across a passage and through the transitional duct to equally disburse the fibers into the rotary tube through its slotted wall and subsequently into the cylindrical mixing chamber of the distributor.

8. The apparatus of claim 1 wherein the round fiber outlet serving as a journal and pneumatic seal is a rotary tube and said rotary tube integrally consists of a smaller diameter fiber entrance tube which forms a rotary connection with the transitional duct and the round outlet of the transitional duct is recessed thus establishing an inner end surface and a circular wall which serve as a journal and a pneumatic seal for a fiber entrance tube.

9. The apparatus of claim 8 wherein sealed ball bearings are press fitted into circular openings of the fiber distributor and the rotary tube is circumferentially supported at perpherial surfaces.

10. The apparatus of claim 1 werein a pulley is secured to the fiber entrance tube of claim 8 and to the drive shaft of claim 1 (a) (1).

11. The apparatus of claim 10 wherein the rotary tube is driven by rotation of a pulley which is interconnected with the entrance end and the drive shaft and travels on guide pulleys.

12. The apparatus of claim 1 wherein the longitudinal slotted wall of the rotary tube provides equal disbursion of fibers into the cylindrical chamber of the distributor wherein airborne fibers are intimately blended and subdivided into multiple outlets.

13. The apparatus of claim 1 wherein negative air pressure transports the fibers from distributor outlets through tubes to a multiplicity/plurality of mini condensers where within each condenser fibers are separated from the airstream by means of an inclined grid which extends form the condenser 's wall to close proximity of a resilient take-out roller by means of air flowing through said grid out of said condenser through a connecting tube into a common manifold which is connected to a suction source by means of a flexible hose.

14. The apparatus of claim 13 wherein equalization of air pressure above the grid of each condenser prior to distribution of fiber among the multiplicity/plurality of condensers is accomplished by manual adjustment of a reed regulator valve attached to each condenser wall and adjacent each exit opening.

15. The apparatus of claim 14 wherein static balancing of condensers compensates for inherent fabrication differences by means of adjusting said valve by moving a regulator screw traversing through a corresponding tapped hole in the condenser wall.

16. The apparatus of claim 15 wherein the regulator screw is held in place by a locknut.

17. The apparatus of claim 13 wherein pressure within the condenser is gauged and monitored by means of a manometer or pressure gauge connected by a tube to an opening in the side wall of the condenser.

18. The apparatus of claim 13 wherein the grid is critically inclined and the valve is critically located to produce fiber assembly at a nip formed by the valve and the takeout roller.

19. The apparatus of claim 13 wherein the rotating resilient take out roller/cylinder forms a pneumatic seal with the condenser and is in close proximity to the terminal end of the grid withdrawing the fibers from the confines of the condenser through a passage thus forming a continuous fibrous ribbon for subsequent textile processing.

20. An apparatus for removing textile fibers from a single source, transporting, collecting, blending, subdividing, and distributing said fibers in equal amounts to multiple remote locations, whereby said fibers are continuously assembled into uniform ribbons for subsequent textile processing or supplied directly to open end spinning units comprising in combination:

a. a fiber feeding means comprising:
   1. a cylinder supported and driven by a shaft, 2. a pneumatic system drawing air from the atmosphere through said cylinder by means of
      A. a vacuum suction, said fiber feeding means discharging into
b. a collecting means comprising a transitional duct encompassing a rectangular to round cross-section with multiple internal baffles, said baffles serving as a means of maintaining equal air velocity gradient across the transitional duct to equally dispurse fibers through a round fiber outlet, said round outlet also serving as a journal and pneumatic seal for
c. a fiber distribution means comprising: an air flotation, elastic ball housed within a spirally vaned conical chamber adjoining a cylindrical fiber mixing chamber having a conical deflector centrally affixed to its fiber exit wall, so that a high velocity air stream under negative pressure laden with fiber entering the connically shaped chamber creates a low pressure area (Venturi) between the ball and the conic wall surface thus forming a circumferential orifice through which airborne fibers enter the conic chamber, a swirling action takes place by virtue of multiple spiral vanes attached to and protruding from the inner surface of the conical chamber thus attaining intimate fiber blending aerodynamically within the chambers without the use of a rotating inner entrance tube and an additional driving means,
d. a means of transporting the fibers from the multiple outlets to a multiplicity/plurality of condensing units or open-end spinners comprising a plurality of tubes,
e. a condensing unit comprising a grid surface to separate fibers from the airstream and
f. a rotatable take-out cylinder adjacent to and in contact with each fiber condenser forming a pneumatic seal, and in close proximity to the grid surface within the condenser, rotating at a high speed, thereby withdrawing fibers from the confines of said condenser resulting in a continuous forming of a fiber ribbon, at a determined production rate,
g. a curved deflection plate in close proximity to said rotating take-out cylinder serving as a guide for feeding the newly formed fibrous ribbon to a subsequent process.

21. The apparatus defined in claim 20 wherein a tubular projection of the fiber distributor is press fitted into a recessed round outlet of a duct thus forming a pneumatic seal which allows airborne fibers to enter the conical chamber through a tubular passage.

22. The apparatus defined in claim 20 wherein there are affixed multiple, equally spaced, spirally shaped tapered vanes radially encircling the inner wall surface of the conical chamber said vanes taper from the apex of the conical chamber to an intersection of the conical chamber and the cylindrical chamber.

23. The apparatus of claim 20 wherein an unattached hollow elastic ball is inserted into the apex of the conically shaped chamber, said ball's outside diameter being greater than the inside diameter of the conical chamber so that during operation high velocity air under negative pressure and laden with fibers entering the chamber creates a low pressure area between the outside surface of the ball and the inside wall surface of the conical chamber and by virtue of the low pressure created by the air movement, the ball is aerodynamically positioned and held symetrically within the confines of the chamber, establishing a circumferential channel during operation, thus providing a means for equal distribution of air, laden with fiber (through said circumferential channel) into said conical chamber so that as the air laden with fibers enters the chamber, it is caused to divide by virtue of the "conanda effect," a portion clinging to the outside surface of the ball and a portion clinging to the inside wall surface of the conic chamber resulting in the portion of air clinging to the surface being forced to swirl by virtue of the vanes and the portion of air clinging to the surface of the ball is compelled to converge centrally as it leaves the surface of the ball.

24. The apparatus of claim 23 wherein there is affixed to the fiber exit wall of the cylindrical chamber a conic deflector, and fiber exit openings are equally spaced apart and surround the conic deflector to obtain efficient pneumatic blending as the converging fibers are deflected by the conic deflector into the swirling stream of fibers.

25. The apparatus as defined in claim 20 wherein a fiber distributor in positions other than vertical, and extended conical deflector is employed to confine the ball to the vicinity of the apex of the conical chamber.

26. The apparatus as defined in claim 1 wherein the fibers are drawn from the distributor through a tube into an entrance passage of a stationary member by negative air pressure and the fiber passage converges into a venturi so that as each fiber's velocity increases through the venturi its configuration changes straightening and aligning each fiber prior to entry into an open-end and spinner rotor.

27. The apparatus of claim 26 wherein the fibers are drawn into the rotor either by means of a suction source or by the pumping action of the rotor through peripheral holes, said suction and centrifugal force, resulting in fibers being deposited into a circular apex of the rotor.

28. The apparatus of claim 26 wherein the rotor is rotatably supported by ball bearings in a spinner housing and the rotor is driven by a belt so that rotation of the rotor in combination with a yarn take out means results in formation of yarn within the rotor.

29. The apparatus of claim 26 wherein a spinner housing is circularly recessed, forming an air passage containing a circular hole for continuity of air flow to the suction source through a connecting tube.

30. The apparatus of claim 1 wherein the collecting means comprising a transitional duct encompassing a rectangular to round cross-section with multiple internal baffles, said baffles serving as a means of maintaining equal air velocity gradient across the transitional duct to equally disperse fibers through a round outlet is a straight member coupled to the fiber feeding means and the fiber distribution means.

31. The apparatus of claim 1 wherein the collecting means comprising a transitional duct encompassing a rectangular to round cross-section with multiple internal baffles, said baffles serving as a means of maintaining equal air velocity gradient across the transitonal duct to equally disperse fibers through a round outlet is an off-set member to allow coupling and alignment between the feeding means and the fiber distribution means,

32. A method for removing textile fibers from a single source, transporting, collecting, blending, subdividing, and distributing said fibers in equal amounts to multiple remote locations, whereby said fibers are continuously assembled into uniform ribbons for subsequent textile processing comprising:

a. feeding fiber from a cylindrical means using b. a pneumatic system which draws air from the atmosphere through said cylindrical means by means of a vacuum suction and c. discharging the fiber from the feed cylinder d. collecting said fiber discharge by means of a transitional duct encompassing a rectangular to round cross-section with multiple internal baffles, said baffles serving as a means of maintaining equal air velocity gradient across the discharge means e. pneumatically sealing said collecting means to a distribution means, f. distributing said collected fibers by means of a rotating fiber entrance tube, longitudinally slotted and dispursing said fibers into a cylindrical chamber wherein the fibers are intimately blended and subdivided into multiple outlets g. transporting said fibers from said outlets to complimentary condensers comprising a grid surface to separate the fibers from said air stream h. rotatably taking out said fibers from said condenser using a rotatable take-out cylinder adjacent to and in contact with each fiber condenser and then i. forming said fibers into a continuous ribbon.

33. The method of claim 32 wherein the fibers are transported from the distributing means to an open-end spinning unit.

34. The method of claim 32 wherein fibers are drawn into said collecting means by means of a high velocity negative air stream through a nozzle.

35. A method for removing textile fibers from a single source, transporting, collecting, blending, subdividing, and distributing said fibers in equal amounts to multiple remote locations, whereby said fibers are continuously assembled into uniform ribbons for subsequent textile processing comprising:

a. feeding fiber from a cylindrical means using b. a pneumatic system which draws air from the atmosphere through said cylindrical means by means of a vacuum suction and c. discharging the fiber from the feed cylinder, d. collecting said fiber discharge by means of a transitional duct encompassing a rectangular to round cross-section with multiple internal baffles, said baffles serving as a means of maintaining equal air velocity gradient across the discharge means, e. pneumatically sealing said collecting means to a distribution means, f. distributing said collected fibers by means of an air flotation, elastic ball housed with a spirally vaned conical chamber adjoining a cylindrical fiber mixing chamber having a conical deflector centrally affixed to its fiber exit wall, so that a high velocity air stream under negative pressure laden with fiber entering the connically shaped chamber creates a low pressure area between the ball and the conic wall surface thus forming a circumferential orfice through which airborne fibers enter the conic chamber, a swirling action takes place by virtue of multiple spiral vanes attached to and protruding from the inner surface of the conical chamber thus attaining intimate fiber blending aerodynamically within the chambers, g. transporting said fibers from said outlets to complimentary condensers comprising a grid surface to separate the fibers from said air stream, h. rotatably taking out said fibers from said condenser using a rotatable take-out cylinder adjacent to and in contact with each fiber condenser and then i. forming said fibers into a continuous ribbon.

36. The method of claim 35 wherein the fibers are transported from the distributing means to an open-end spinning unit.

37. The method of claim 35 wherein fibers are drawn into said collecting means by means of a high velocity negative air stream through a nozzle.

* * * * *

UNITED STATES PATENT OFFICE

CERTIFICATE OF CORRECTION

Patent No. 4,030,280 Dated June 21, 1977

Inventor(s) Craig L. Folk and James I. Kotter

It is certified that error appears in the above-identified patent and that said Letters Patent are hereby corrected as shown below:

Figure 1, change symbol "59" to -- 159 --.
Figure 1, symbol "33" should be connected by a lead line to the cylindrical chamber of distributor 34.
Figure 2, change symbol "30" to -- 130 --.
Figure 2, add symbol "26" to designate the thumbscrew inserted in hole 27.
Figure 4, change symbol "60" to -- 160 --.
Figure 5, extend lead line of symbol 75 to the tapered valve
Figure 7, change symbol "91" to -- 191 --.

Col. 3, line 54, change "protubrance 30" to -- protubrance 130 --.
Col. 4, line 25, change "flexible hose 59" to -- flexible hose 159 --.
Lines 33 and 34, change "tapped hole 60" to -- tapped hole 160 --.
Line 45, change "valve 57" to -- grid 52 --.
Col. 5, lines 16 and 17, change "surface 77" to -- surface 74 --.
Lines 19 and 20, insert a period -- . -- after "centrally" and cancel "as it leaves surface 76 of ball 75."
Line 27, change "Fig. 6" to -- Fig. 5 --.
Lines 43 and 44, change "tube 91" to -- tube 191 --.
Line 56, change "(99 not shown)" to -- 99 --.
Col. 7, line 32, change "disbursion" to -- dispersion --.
Line 65, change "valve" to -- grid --.
Col. 8, line 25, cancel "journal and".

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*